US010401778B2

(12) United States Patent
Hayashi et al.

(10) Patent No.: US 10,401,778 B2
(45) Date of Patent: Sep. 3, 2019

(54) IMAGE FORMING APPARATUS, CONTINUOUS-MEDIUM TRANSPORT DEVICE, AND IMAGE FORMING SYSTEM

(71) Applicant: FUJI XEROX CO., LTD., Tokyo (JP)

(72) Inventors: Yoshihiro Hayashi, Kanagawa (JP); Yuki Yokoyama, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 93 days.

(21) Appl. No.: 15/497,645

(22) Filed: Apr. 26, 2017

(65) Prior Publication Data

US 2018/0032019 A1 Feb. 1, 2018

(30) Foreign Application Priority Data

Jul. 28, 2016 (JP) ..... 2016-148975

(51) Int. Cl.
*G03G 15/00* (2006.01)

(52) U.S. Cl.
CPC ..... *G03G 15/70* (2013.01); *G03G 15/6517* (2013.01); *G03G 15/6529* (2013.01)

(58) Field of Classification Search
CPC . G03G 15/70; G03G 15/6529; G03G 15/6517
See application file for complete search history.

(56) References Cited

U.S. PATENT DOCUMENTS 4,371,418 A * 2/1983 Krywiczanin ..... B65H 19/105 156/497
4,848,634 A * 7/1989 Crowley ..... B41J 11/58 226/108
5,076,891 A * 12/1991 Link ..... D21G 1/022 100/328
5,372,290 A * 12/1994 Marmin ..... B41F 33/18 101/228
5,423,496 A * 6/1995 Roder ..... B65H 19/1815 242/555.5
6,065,401 A * 5/2000 Marmin ..... B65H 26/025 101/228
6,840,165 B1 * 1/2005 Leppakoski ..... D21G 9/0009 100/168
2007/0194258 A1 * 8/2007 Brandmeier ..... B41F 33/18 250/573
2008/0251223 A1 * 10/2008 Lares ..... D21G 1/006 162/123

(Continued)

FOREIGN PATENT DOCUMENTS

JP 2006-1163 A 1/2006
JP 2011-177948 A 9/2011
WO 03/106178 A1 12/2003

OTHER PUBLICATIONS

Office Action for Japanese Patent Application No. 2016-148975, dated Feb. 28, 2017.

*Primary Examiner* — David H Banh
(74) *Attorney, Agent, or Firm* — Sughrue Mion, PLLC

(57) ABSTRACT

An image forming apparatus includes an image forming section that forms an image on a continuous medium, a transport unit that transports the continuous medium, and a detection unit that detects breakage of the continuous medium transported by the transport unit from a transport state of the continuous medium.

6 Claims, 7 Drawing Sheets

(56) References Cited

U.S. PATENT DOCUMENTS

| | | | | |
|---|---|---|---|---|
| 2013/0010334 | A1* | 1/2013 | Akiba | G03G 15/5083 358/1.16 |
| 2015/0013556 | A1* | 1/2015 | Slaats | B41F 33/18 101/219 |
| 2015/0299952 | A1* | 10/2015 | Kalaniemi | D21G 5/00 348/88 |

* cited by examiner

IMAGE FORMING APPARATUS, CONTINUOUS-MEDIUM TRANSPORT DEVICE, AND IMAGE FORMING SYSTEM

CROSS-REFERENCE TO RELATED APPLICATIONS

This application is based on and claims priority under 35 USC 119 from Japanese Patent Application No. 2016-148975 filed Jul. 28, 2016.

BACKGROUND (i) Technical Field

The present invention relates to an image forming apparatus, a continuous-medium transport device, and an image forming system.

(ii) Related Art

For example, in an image forming apparatus, a continuous medium continuously extending in the transport direction is sometimes transported, and the continuous medium sometimes breaks during transportation. If breakage of the continuous medium is not detected, the continuous medium continues to be transported while remaining divided by the breakage. This may complicate a restoring operation to be performed later.

SUMMARY

According to an aspect of the invention, there is provided an image forming apparatus including an image forming unit that forms an image on a continuous medium, a transport unit that transports the continuous medium, and a detection unit that detects breakage of the continuous medium transported by the transport unit from a transport state of the continuous medium.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described in detail below with reference to the attached drawings.

Figure 1:
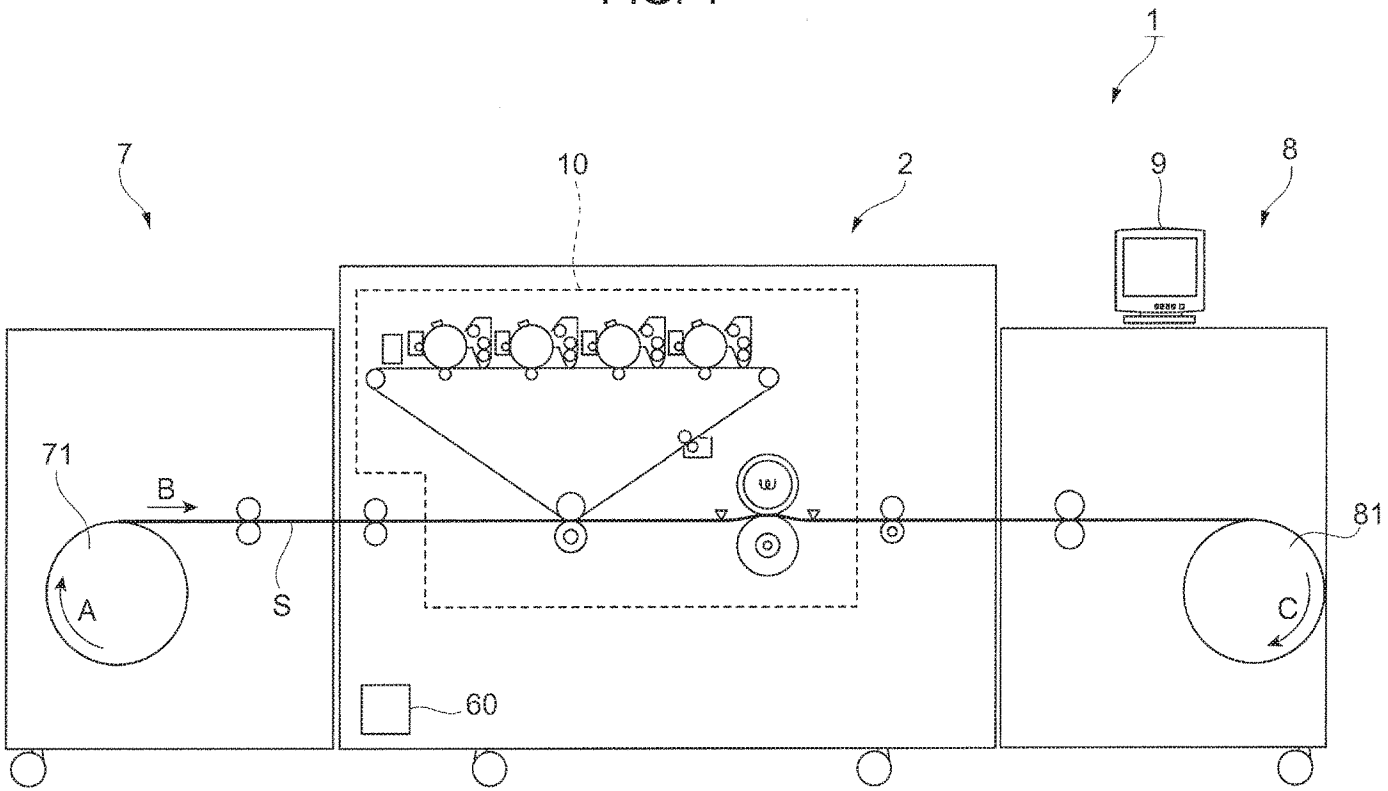
FIG. 1 illustrates a structure example of an image forming system according to an exemplary embodiment.

FIG. 1 illustrates a structure example of an image forming system 1 according to an exemplary embodiment.

The image forming system 1 illustrated in FIG. 1 includes an image forming apparatus 2 that forms an image on a continuous medium S continuously extending in the transport direction, a paper feeding apparatus 7 that supplies the continuous medium S to the image forming apparatus 2, and a collection apparatus 8 that collects the continuous medium S after the image is formed on the continuous medium S in the image forming apparatus 2.

The image forming system 1 also includes a user interface (UI) 9 constituted by, for example, a display panel to receive information from the user and to display information to the user.

In the image forming system 1, as the continuous medium S, for example, a film made of polypropylene (PP) or polyethyleneterephthalate, seal paper constituted by a laminate of a sheet having an adhesive surface and release paper, or plain paper may be used.

While the single image forming apparatus 2 is disposed between the paper feeding apparatus 7 and the collection apparatus 8 in the image forming system 1, for example, two or more image forming apparatuses 2 may be arranged in series.

The image forming system 1 may further include, for example, an inverting device (not illustrated) for inverting a front surface and a back surface of the continuous medium S and a post-processing device (not illustrated) for subjecting the continuous medium S to post processing after an image is formed thereon.

The paper feeding apparatus 7 supplies a continuous medium S wound in a roll form to the image forming apparatus 2 while unwinding the continuous medium S. Specifically, the paper feeding apparatus 7 includes a rotatable paper feeding roller 71 that supports the continuous medium S wound in a roll form.

In the paper feeding apparatus 7, when the paper feeding roller 71 rotates in a direction of arrow A in FIG. 1, the rolled continuous medium S is unwound, is transported in a direction of arrow B in FIG. 1, and is then supplied to the image forming apparatus 2.

The collection apparatus 8 collects the continuous medium S on which an image has been formed in the image forming apparatus 2 while winding the continuous medium S in a roll form. Specifically, the collection apparatus 8 includes a rotatable collection roller 81.

When the collection roller 81 rotates in a direction of arrow C in FIG. 1, the continuous medium S output from the image forming apparatus 2 is wound around the collection roller 81 in a roll form.

Figure 2:
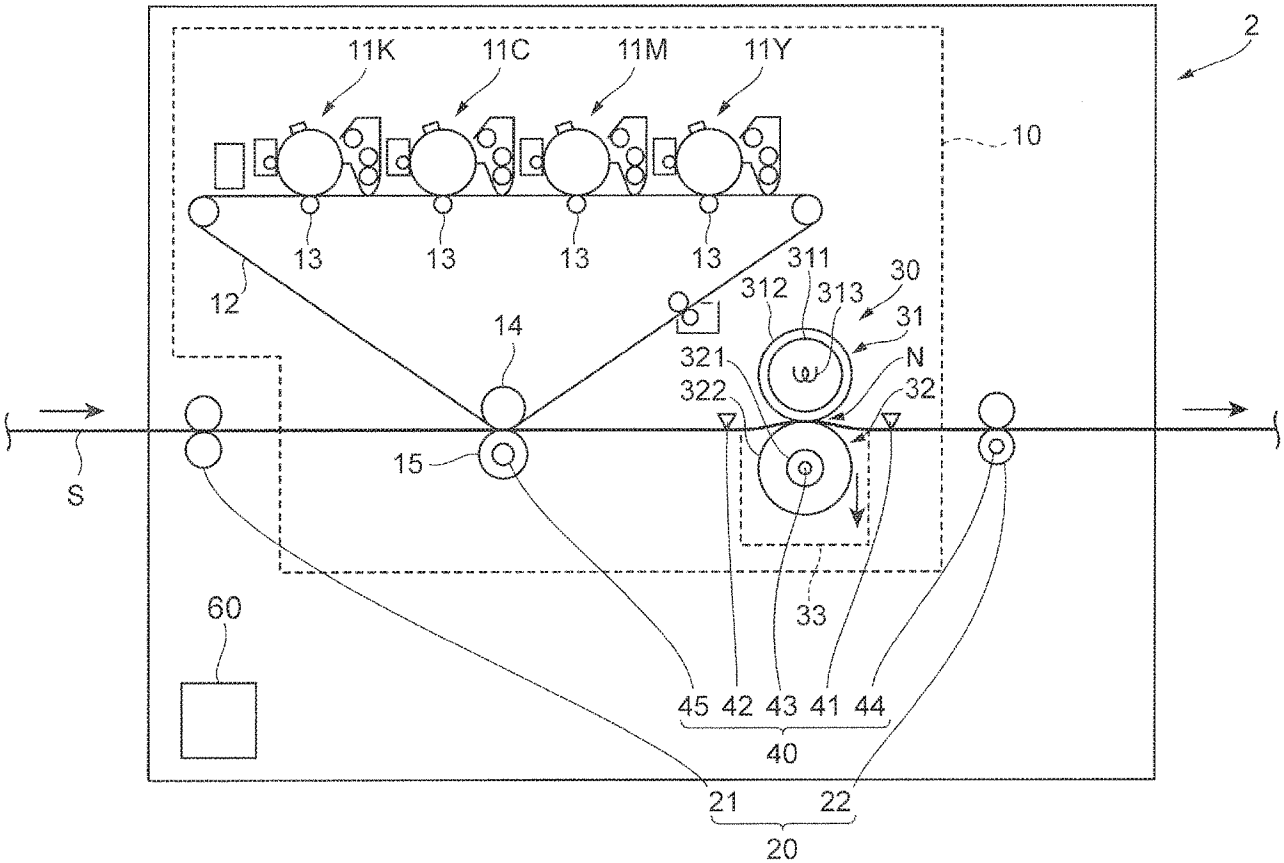
FIG. 2 is a detailed view of an image forming apparatus.

FIG. 2 is a detailed view of the image forming apparatus 2.

As illustrated in FIG. 2, the image forming apparatus 2 includes an image forming section 10 that forms a color image based on image data, and a transport unit 20 serving as an example of a transport unit that transports the continuous medium S.

The image forming apparatus 2 also includes a detection device 40 serving as an example of a detection unit. The detection device 40 detects a transport state of the continuous medium S transported by the transport unit 20, and detects breakage of the continuous medium S from the detection result.

The image forming apparatus 2 further includes a controller 60 that controls the overall operation of the image forming system 1.

Here, the controller 60 is constituted of a central processing unit (CPU), a read only memory (ROM), a random access memory (RAM), and a hard disk drive (HDD) (none of which are illustrated). The CPU executes processing programs. The ROM stores various programs, various tables, and parameters, and so on. The RAM is used as, for example, a work area when the various programs are executed by the CPU.

The image forming section 10 includes image forming units 11. Specifically, the image forming section 10 includes four image forming units 11Y, 11M, 11C, and 11K that are arranged in parallel at regular intervals to respectively form toner images of yellow (Y), magenta (M), cyan (C), and black (K) colors.

The image forming section 10 further includes an intermediate transfer belt 12. The color toner images formed in the image forming units 11 are multi-transferred onto the intermediate transfer belt 12, and the intermediate transfer belt 12 holds and transports the multi-transferred color toner images.

The image forming section 10 further includes first transfer rollers 13 that transfer (first transfer) the color toner images in the image forming units 11 in order onto the intermediate transfer belt 12.

The image forming section 10 further includes a second transfer roller 14 that collectively transfers (second-transfers) a superimposed toner image transferred on the intermediate transfer belt 12 onto a continuous medium S.

The image forming section 10 further includes a backup roller 15 disposed opposed to the second transfer roller 14 with the intermediate transfer belt 12 interposed therebetween. The second transfer roller 14 is pressed against the backup roller 15 with the intermediate transfer belt 12 interposed therebetween.

The image forming section 10 further includes a fixing device 30 serving as an example of a fixing unit that fixes the transferred toner image on the continuous medium S.

The fixing device 30 includes a fixing roller 31 and a pressurizing roller 32 opposed to the fixing roller 31.

The fixing roller 31 includes a cylindrical core metal 311 made of metal such as aluminum or iron, and a surface release layer 312. The surface release layer 312 is made of, for example, fluororesin that covers an outer peripheral surface of the core metal 311, and suppresses accumulation of offset toner and paper dust from the continuous medium S.

The fixing roller 31 also includes a heater 313 provided inside the core metal 311 to heat the core metal 311. As the heater 313, for example, a halogen lamp is used.

The pressurizing roller 32 includes a shaft 321 and a cylindrical elastic layer 322. The shaft 321 is made of metal such as stainless steel or iron. The elastic layer 322 is disposed on an outer side of the shaft 321 and is made of a material such as silicone rubber.

The pressurizing roller 32 is pressed against the fixing roller 31 to form a nip N therebetween. The continuous medium S is to pass through the nip N.

In the fixing device 30, the fixing roller 31 is rotated in one direction (in the counterclockwise direction in FIG. 2) at a predetermined speed. The pressurizing roller 32 in contact with the fixing roller 31 rotates in one direction (in the clockwise direction in FIG. 2) while following the rotation of the fixing roller 31. That is, the pressurizing roller 32 is rotated in operative association with the fixing roller 31 while receiving the rotational driving force from the fixing roller 31.

In the fixing device 30, a pressurized state and a released state are switched under the control of the controller 60. Specifically, in this exemplary embodiment, an advancing/retreating mechanism 33 is provided to advance and retreat the pressurizing roller 32 relative to the fixing roller 31. This advancing/retreating mechanism 33 puts the fixing device 30 in either the pressurized state or the released state.

The term "released state" refers to a state in which the press of the pressurizing roller 32 against the fixing roller 31 (pressurization at the nip N) is removed and the fixing roller 31 and the pressurizing roller 32 are separate from each other. In this exemplary embodiment, when the fixing device 30 is in the released state, the continuous medium S is located between the fixing roller 31 and the pressurizing roller 32, but is separate from both the fixing roller 31 and the pressurizing roller 32.

The term "pressurized state" refers to a state in which the pressurizing roller 32 is pressed against the fixing roller 31 and the nip N is formed between the fixing roller 31 and the pressurizing roller 32. When the fixing device 30 is in the pressurized state, the continuous medium S is raised by the pressurizing roller 32 and is pressed against the fixing roller 31 at the nip N.

Next, a transport system for the continuous medium S will be described.

The transport unit 20 includes an entrance roller 21 and an exit roller 22.

The entrance roller 21 transports a continuous medium S supplied from the paper feeding apparatus 7 to the image forming system 1 to a second transfer portion where the second transfer roller 14 and the backup roller 15 are in pressure contact with each other.

The exit roller 22 transports the continuous medium S toward the collection apparatus 8 after the toner image is fixed on the continuous medium S by the fixing device 30.

The entrance roller 21, the second transfer roller 14, the backup roller 15, the fixing device 30, and the exit roller 22 constitute an example of a continuous-medium transport device.

The detection device 40 includes an optical sensor 41, an actuator 42, a pressurizing-roller torque sensor 43, an exit-roller torque sensor 44, and an encoder 45.

The optical sensor 41 is provided immediately after the fixing device 30 in the transport direction of the continuous medium S.

The optical sensor 41 emits light from a light source toward the continuous medium S transported from the fixing device 30. Then, the optical sensor 41 receives reflected light from the continuous medium S by a light receiving portion, and thereby detects the presence of the continuous medium S.

Further, the optical sensor 41 detects the absence of the continuous medium S when light emitted from a light emitting portion does not reach the light receiving portion.

In this case, the controller 60 determines that the continuous medium S breaks on the upstream side of the optical sensor 41 in the transport direction of the continuous medium S.

The actuator 42 is provided immediately before the fixing device 30 in the transport direction of the continuous medium S. Also, the actuator 42 nips the continuous medium S.

When the actuator 42 nips the continuous medium S, a lever (not illustrated) provided in the actuator 42 is displaced. While the actuator 42 is nipping the continuous medium S, light emitted from a light emitting portion of the actuator 42 is blocked by the displaced lever. Thus, the presence of the continuous medium S is detected.

On the other hand, while the actuator 42 is not nipping the continuous medium S, light emitted from the light emitting portion is received by a light receiving portion without being blocked by the lever.

In this case, the controller 60 that receives output from the actuator 42 determines that the continuous medium S has broken on the upstream side of the actuator 42 in the transport direction of the continuous medium S.

The pressurizing-roller torque sensor 43 detects the driving torque of the pressurizing roller 32 by measuring the current value in a driving motor (not illustrated) of the pressurizing roller 32.

While the fixing device 30 is not transporting the continuous medium S, the current value in the driving motor of the pressurizing roller 32 is lower than when the fixing device 30 is transporting the continuous medium S.

When the current value is lower than or equal to a predetermined value, the controller 60 determines that the continuous medium S has broken in the fixing device 30 or on the upstream side of the fixing device 30 in the transport direction of the continuous medium S.

The exit-roller torque sensor 44 detects the driving torque of the exit roller 22 by measuring the current value in a driving motor (not illustrated) of the exit roller 22.

When the current value is lower than or equal to a predetermined value, the controller 60 determines that the continuous medium S has broken at the exit-roller torque sensor 44 or on the upstream side of the exit-roller torque sensor 44 in the transport direction of the continuous medium S.

The encoder 45 measures the rotation speed of the backup roller 15.

When the backup roller 15 is not transporting the continuous medium S, the rotation speed of the backup roller 15 is higher than when the backup roller 15 is transporting the continuous medium S.

When the rotation speed is higher than or equal to a predetermined value, the controller 60 determines that the continuous medium S has broken at the backup roller 15 or on the upstream side of the backup roller 15 in the transport direction of the continuous medium S.

In this way, the detection device 40 detects breakage of the continuous medium S when the continuous medium S is not present at the predetermined position in the transport path inside the image forming apparatus 2.

FIGS. 3A, 3B, 3C, and 3D illustrate an operation of the image forming system 1 when the continuous medium S breaks at the fixing device 30 during transportation.

Figure 3A:
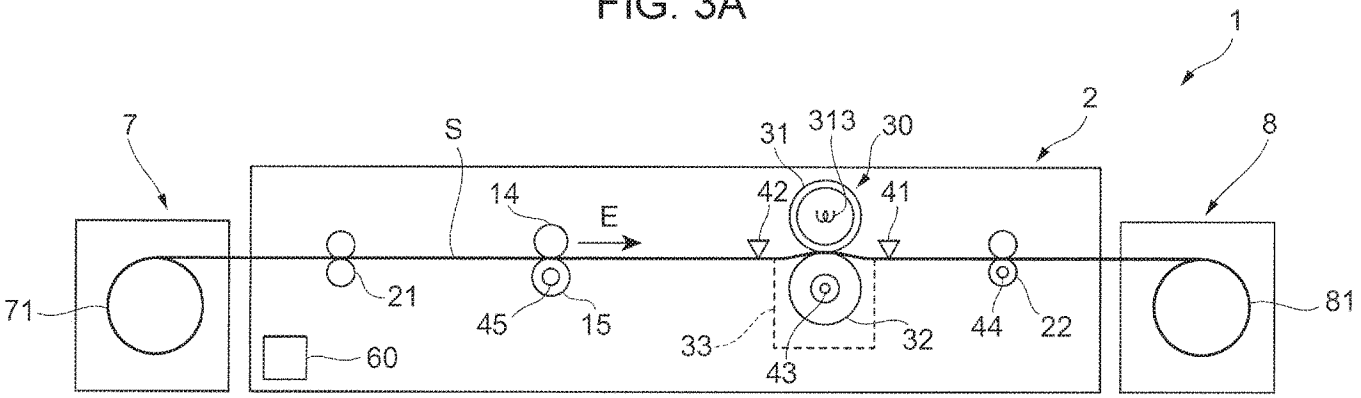
FIGS. 3A, 3B, 3C, and 3D illustrate an operation example of the image forming system when a continuous medium breaks during transportation.

As illustrated in FIG. 3A, in the image forming system 1, the continuous medium S is transported in a direction of arrow E in FIG. 3A from the paper feeding roller 71 of the paper feeding apparatus 7 toward the collection roller 81 of the collection apparatus 8 (toward the downstream side in the transport direction).

Figure 3B:
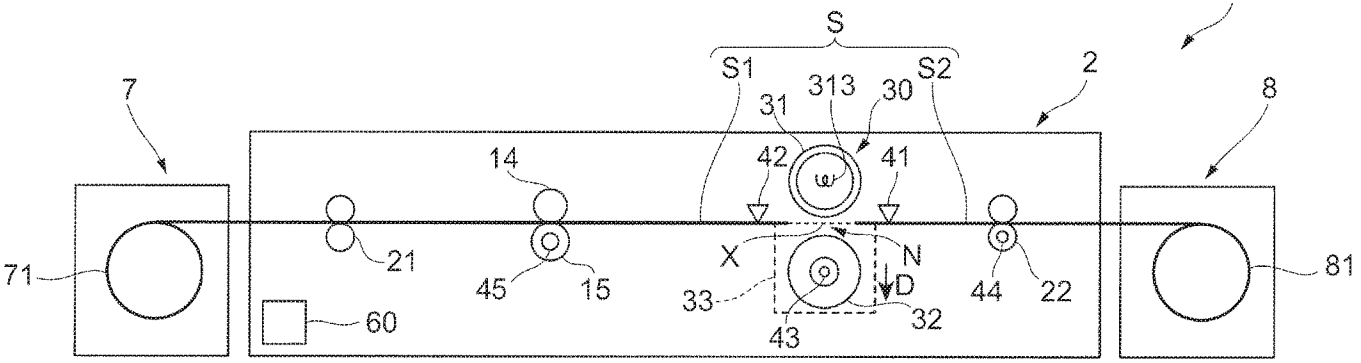

Here, it is assumed that the continuous medium S has broken owing to the fixing device 30, as illustrated in FIG. 3B. Breakage of the continuous medium S owing to the fixing device 30 is caused by, for example, melting of a part of the continuous medium S. Specifically, the part of the continuous medium S is heated and melted by the fixing roller 31, and as a result, the continuous medium S is broken.

When the continuous medium S breaks in the fixing device 30, the fixing device 30 does not transport the continuous medium S. As a result, the pressurizing-roller torque sensor 43 detects that the current value in the driving motor of the pressurizing roller 32 becomes lower than or equal to the predetermined value.

On the other hand, both the optical sensor 41 and the actuator 42 detect the presence of the continuous medium S.

Thus, the controller 60 determines that a position X where the continuous medium S has broken is at the position where the fixing device 30 is located, in the transport path of the continuous medium S.

In this exemplary embodiment, when the pressurizing-roller torque sensor 43 detects breakage of the continuous medium S, transportation of the continuous medium S is stopped. Also, power feeding to the heater 313 of the fixing roller 31 is stopped.

Further, when the pressurizing-roller torque sensor 43 detects breakage of the continuous medium S, the advancing/retreating mechanism 33 moves the pressurizing roller 32 in a direction of arrow D in FIG. 3B to release pressurization at the nip N. Thus, the continuous medium S separates from the fixing roller 31 and the pressurizing roller 32.

Figure 3C:
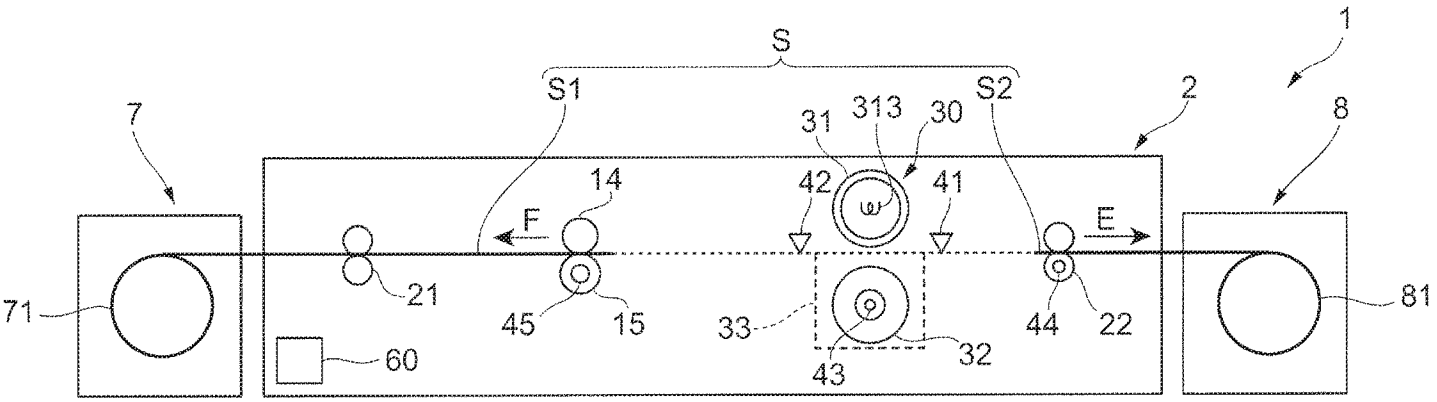

Next, the paper feeding roller 71, the entrance roller 21, the second transfer roller 14, and the backup roller 15 are driven to transport a part S1 of the continuous medium S located on the upstream side in the transport direction (a part located on the upstream side of the position where the breakage occurs) (hereinafter referred to as "upstream part S1") in a direction of arrow F in FIG. 3C (toward the upstream side in the transport direction), as illustrated in FIG. 3C. The upstream part S1 is taken up by the paper feeding roller 71.

Further, the exit roller 22 and the collection roller 81 are driven to transport a part S2 of the continuous medium S located on the downstream side in the transport direction (a part located on the downstream side of the position where the breakage occurs) (hereinafter referred to as "downstream part S2") in a direction of arrow E in FIG. 3C (toward the downstream side in the transport direction). The downstream part S2 is thereby taken up by the collection roller 81.

Figure 3D:
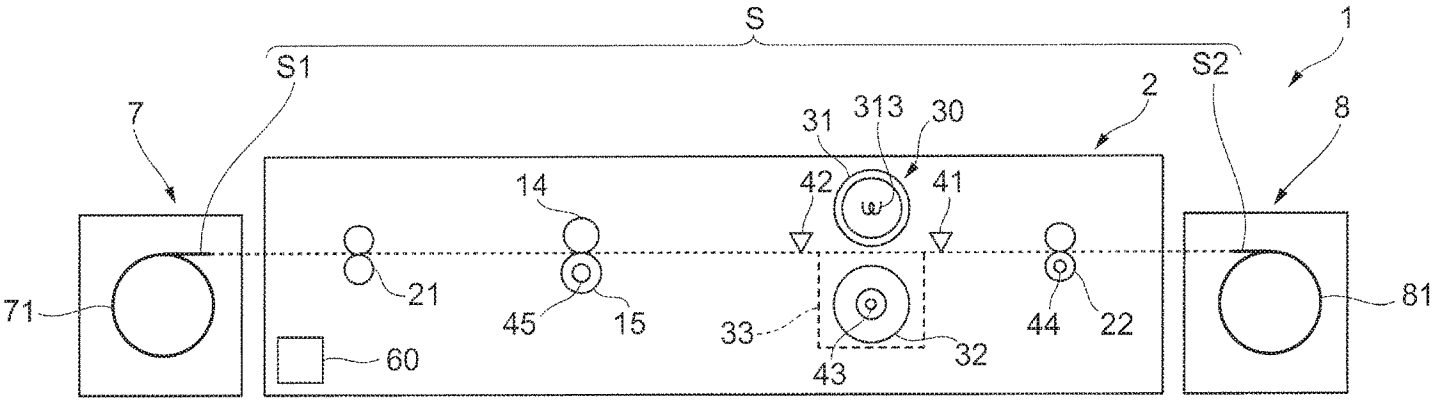

When taken up by the paper feeding roller 71, as illustrated in FIG. 3D, the upstream part S1 is located outside the image forming apparatus 2.

When taken up by the collection roller 81, the downstream part S2 is also located outside the image forming apparatus 2.

In this way, in this exemplary embodiment, when it is detected that the continuous medium S has broken in the fixing device 30, the upstream part S1 is taken up and collected from the image forming apparatus 2, and the downstream part S2 is taken up and collected from the image forming apparatus 2.

When the continuous medium S breaks, the upstream part S1 and the downstream part S2 are sometimes joined to be used again in the image forming system 1. Specifically, a downstream edge portion of the upstream part S1 in the transport direction and an upstream edge portion of the downstream part S2 in the transportation are sometimes joined to be used again. In this case, to join the upstream part S1 and the downstream part S2 together, it is necessary to perform a repairing operation for the downstream edge portion of the upstream part S1 and a repairing operation for the upstream edge portion of the downstream part S2.

The above repairing operations are often difficult when the upstream part S1 and the downstream part S2 are left inside the image forming apparatus 2 even after the continuous medium S breaks.

In contrast, in this exemplary embodiment, the upstream part S1 is discharged out of the image forming apparatus 2 and the downstream part S2 is discharged out of the image forming apparatus 2.

Figure 4A:
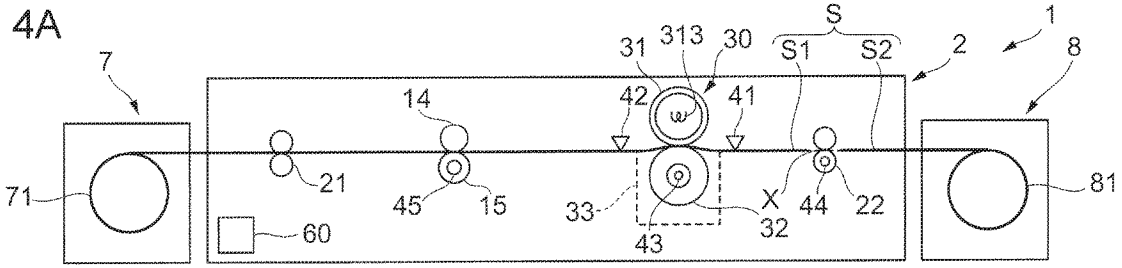
FIGS. 4A, 4B, and 4C illustrate another operation example of the image forming system when a continuous medium breaks during transportation.
Figure 4B:
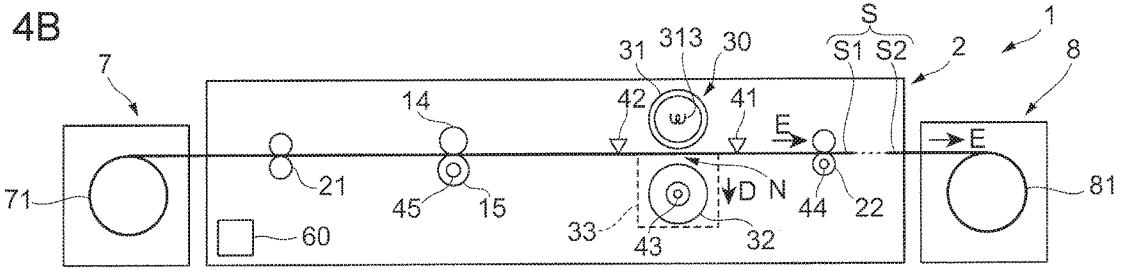
Figure 4C:
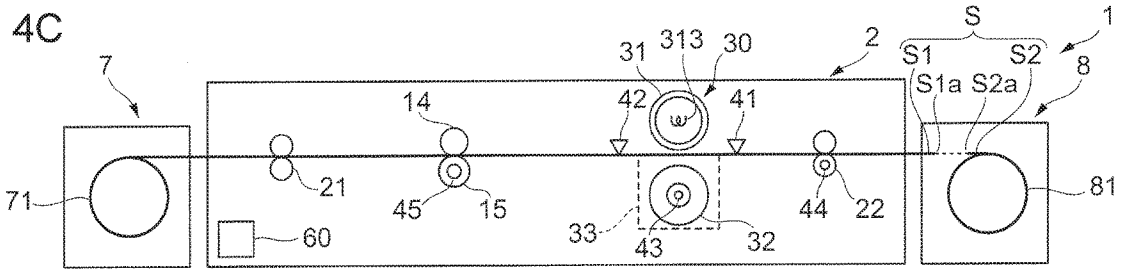

FIGS. 4A, 4B, and 4C illustrate another operation example of the image forming system 1 when a continuous medium S breaks during transportation.

As illustrated in FIG. 4A, when the continuous medium S breaks at a position where the exit roller 22 is provided, the exit roller 22 does not transport the continuous medium S. As a result, the exit-roller torque sensor 44 detects that the current value in the driving motor of the exit roller 22 becomes lower than or equal to the predetermined value.

On the other hand, the optical sensor 41 detects the presence of the continuous medium S.

Thus, the controller 60 determines that the position X where the continuous medium S has broken is at the position of the exit roller 22 or between the position of the exit roller 22 and the position of the optical sensor 41.

When the exit-roller torque sensor 44 detects breakage of the continuous medium S, transportation of the continuous medium S is stopped. Also, power feeding to the heater 313 of the fixing roller 31 is stopped.

When the exit-roller torque sensor 44 detects the breakage of the continuous medium S, as illustrated in FIG. 4B, the advancing/retreating mechanism 33 moves the pressurizing roller 32 in the direction of arrow D in FIG. 4B to release pressurization at the nip N.

Next, in this exemplary embodiment, the paper feeding roller 71, the entrance roller 21, the second transfer roller 14, and the backup roller 15 are driven to transport an upstream part S1 of the continuous medium S in the direction of arrow E in FIG. 4B (toward the downstream side in the transport direction).

Also, the collection roller 81 is driven to transport a downstream part S2 of the continuous medium S in the direction of arrow E in FIG. 4B (toward the downstream side in the transport direction). Thus, the downstream part S2 is taken up by the collection roller 81.

When the upstream part S1 is transported toward the downstream side in the transport direction, as illustrated in FIG. 4C, a downstream edge portion S1*a* of the upstream part S1 in the transport direction is located outside the image forming apparatus 2 and inside the collection apparatus 8.

When the downstream part S2 is taken up by the collection roller 81, an upstream edge portion S2*a* of the downstream part S2 in the transport direction is also located outside the image forming apparatus 2 and inside the collection apparatus 8.

In this way, in this exemplary embodiment, when breakage of the continuous medium S is detected, both the downstream edge portion S1*a* and the upstream edge portion S2*a* are discharged out of the image forming apparatus 2 and put into the collection apparatus 8.

When the upstream part S1 and the downstream part S2 are joined to be used again in the image forming system 1, it is necessary to perform an operation of joining the downstream edge portion S1*a* of the upstream part S1 and the upstream edge portion S2*a* of the downstream part S2 (joint operation) after the above-described repairing operations.

Here, when the upstream part S1 and the downstream part S2 are separately discharged out of the image forming apparatus 2 to the upstream side and the downstream side, respectively, after the continuous medium S breaks, as illustrated in FIGS. 3C and 3D, the joint operation is apt to be troublesome. Specifically, in this case, it is necessary to manually move one of the upstream part S1 and the downstream part S2 to the other, and this makes the joint operation troublesome.

More specifically, in this case, for example, it is necessary to perform the joint operation after manually carrying the upstream part S1 to the position of the downstream part S2 through the inside of the image forming apparatus 2 (carrying the upstream part S1 to the collection apparatus 8), and the joint operation takes much trouble. Also, when the downstream part S2 is carried to the position of the upstream part S1 through the inside of the image forming apparatus 2, the joint operation similarly takes much trouble.

In contrast, in the operation example illustrated in FIGS. 4B and 4C, it is unnecessary to manually carry the upstream part S1 or the downstream part S2.

Figures 5A, 5B, 5C:
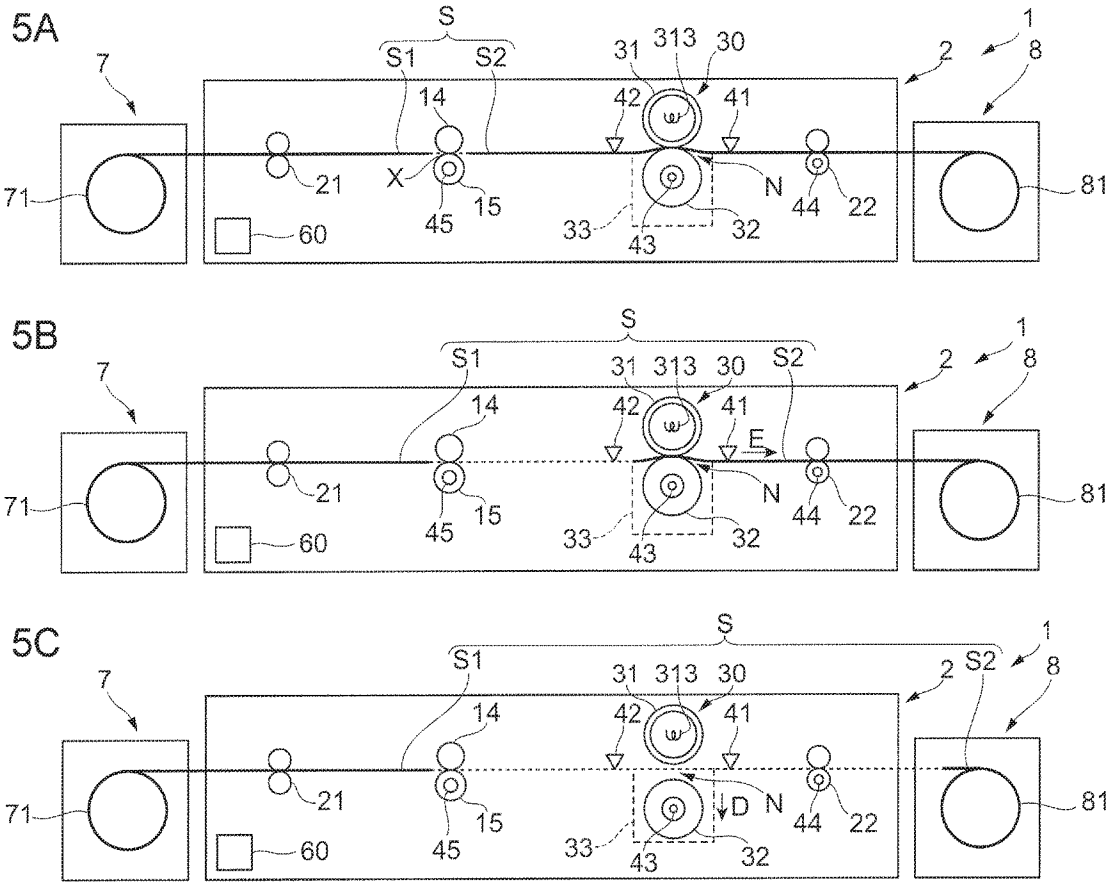
FIGS. 5A, 5B, and 5C illustrate a further operation example of the image forming system when a continuous medium breaks during transportation.

FIGS. 5A, 5B, and 5C illustrate a further operation example of the image forming system 1 when a continuous medium S breaks during transportation.

As illustrated in FIG. 5A, when the continuous medium S breaks at a position where the backup roller 15 is provided, the second transfer roller 14 and the backup roller 15 do not transport the continuous medium S. As a result, the encoder 45 detects that the rotation speed of the backup roller 15 becomes higher than or equal to the predetermined value.

Thus, the controller 60 determines that the position X where the continuous medium S has broken is at the position of the backup roller 15 or on the upstream side of the backup roller 15 in the transport direction of the continuous medium S.

When the encoder 45 detects breakage of the continuous medium S, transportation of the continuous medium S is stopped. In this operation example, power feeding to the heater 313 of the fixing roller 31 is not stopped, but the fixing roller 31 is kept heated. Also, the pressurizing roller 32 is not moved by the advancing/retreating mechanism 33, but pressurization at the nip N is maintained.

At this time, an unfixed toner image is provided on a portion of a downstream part S2 between the position of the second transfer roller 14 and the position of the fixing device 30.

Next, the fixing device 30, the exit roller 22, and the collection roller 81 are driven to transport the downstream part S2 of the continuous medium S in the direction of arrow E in FIG. 5B (toward the downstream side in the transport direction), as illustrated in FIG. 5B. Then, the downstream part S2 is taken up by the collection roller 81.

At this time, the portion of the downstream part S2 on which the unfixed toner image is provided passes through the fixing device 30. Thus, the toner image is fixed on the downstream part S2.

As illustrated in FIG. 5C, when the downstream part S2 is transported to the downstream side of the fixing device 30, the fixing device 30 does not transport the continuous medium S. As a result, the pressurizing-roller torque sensor 43 detects that the current value in the driving motor of the pressurizing roller 32 becomes lower than or equal to the predetermined value.

When the pressurizing-roller torque sensor 43 detects the absence of the continuous medium S, power feeding to the heater 313 of the fixing roller 31 is stopped. Also, the pressurizing roller 32 is moved by the advancing/retreating mechanism 33 in the direction of arrow D in FIG. 5C to release pressurization at the nip N.

When the downstream part S2 is taken up by the collection roller 81, it is located outside the image forming apparatus 2.

In this way, in this exemplary embodiment, when it is detected that the continuous medium S has broken on the upstream side of the fixing device 30 in the transport direction, heating of the fixing roller 31 and pressurization at the nip N are maintained until the downstream part S2 is transported to the downstream side of the fixing device 30.

In the structure in which heating of the fixing roller 31 and pressurization at the nip N are released simultaneously with detection of breakage of the continuous medium S, the downstream part S2 on which the unfixed toner image is left is discharged out of the image forming apparatus 2. Additionally, the downstream part S2 is discharged to the outside of the image forming apparatus 2 while the unfixed toner image formed on the part of the downstream part S2 remains unfixed on the downstream part S2.

In this case, the unfixed toner image travels toward the collection apparatus 8 through the image forming apparatus 2, and this unfixed toner image may adhere inside the image forming apparatus 2 and inside the collection apparatus 8.

In contrast, in the structure in which heating of the fixing roller 31 and pressurization at the nip N are maintained until the downstream part S2 is transported to the downstream side of the fixing device 30 as in this exemplary embodiment, the unfixed toner image formed on the part of the downstream part S2 is fixed on the downstream part S2.

In this exemplary embodiment, when it is detected that the continuous medium S has broken on the upstream side of the fixing device 30 in the transport direction, as illustrated in FIGS. 5B and 5C, the upstream part S1 is not transported to the downstream side in the transport direction, but transportation of the upstream part S1 is stopped.

In the exemplary embodiment, a stripping member for stripping the continuous medium S from the fixing roller 31 is not provided, and the continuous medium S is apt to be wound around the fixing device 30. More specifically, the continuous medium S is laid between the paper feeding roller 71 and the collection roller 81 in a tensioned manner, and is rarely wound around the fixing device 30. Hence, the stripping member is not provided in the exemplary embodiment. In this case, however, the continuous medium S is apt to be wound around the fixing device 30. In this structure, when the continuous medium S breaks, it is easily wound around the fixing device 30.

In the structure in which the upstream part S1 is transported to the downstream side in the transport direction after the continuous medium S breaks on the upstream side of the fixing device 30 in the transport direction, the upstream part S1 reaches the fixing device 30. In this case, the upstream part S1 that reaches the fixing device 30 may be wound around the fixing roller 31.

In contrast, in the structure in which transportation of the upstream part S1 is stopped without transporting the upstream part S1 to the downstream side in the transport direction, as in the exemplary embodiment, the upstream part S1 is prevented from reaching the fixing device 30.

When it is detected that the continuous medium S has broken at the position of the fixing device 30, transportation of the upstream part S1 may be stopped.

Figures 6A, 6B, 6C:
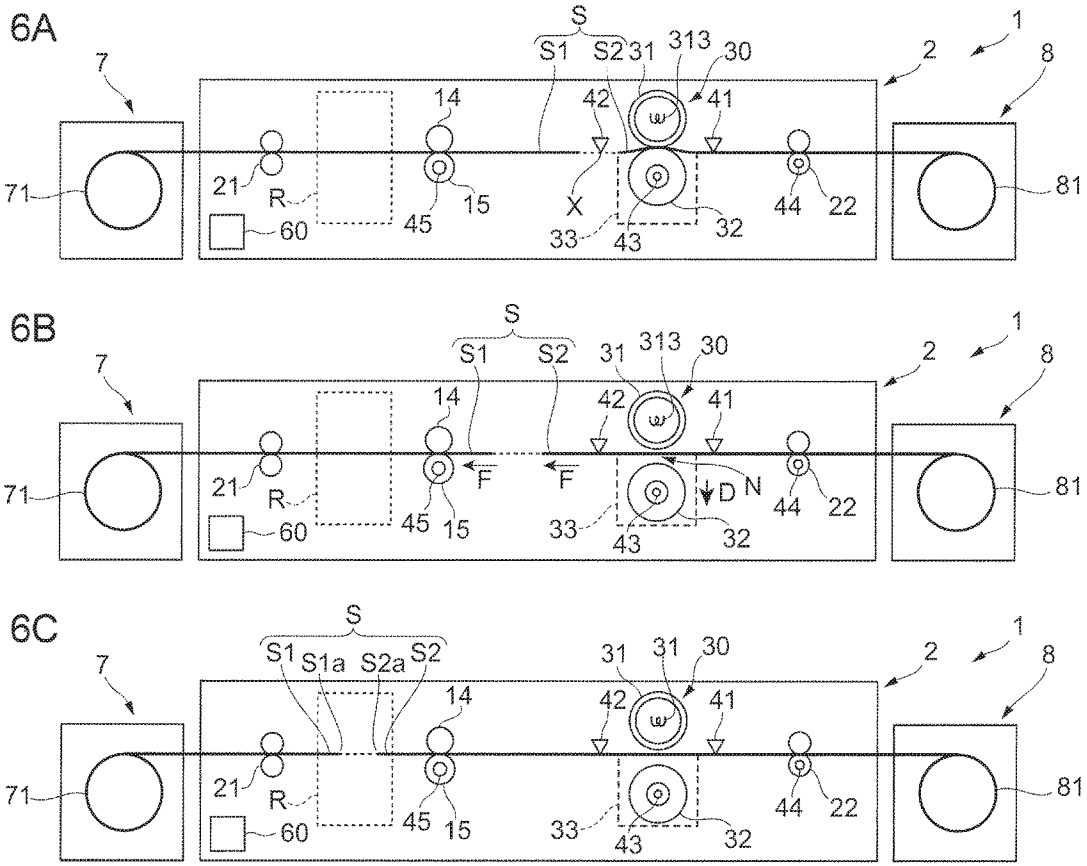
FIGS. 6A, 6B, and 6C illustrate an operation of an image forming system according to another exemplary embodiment.

FIGS. 6A, 6B, and 6C illustrate an operation of an image forming system 1 according to another exemplary embodiment.

In this exemplary embodiment, as illustrated in FIG. 6A, a working area R is provided inside an image forming apparatus 2. Specifically, the working area R is provided between an entrance roller 21, and a second transfer roller 14 and a backup roller 15.

The working area R allows a repairing operation for an edge portion of a broken continuous medium S and a joint operation of an upstream part S1 and a downstream part S2 to be performed inside the image forming apparatus 2.

Here, it is assumed that a continuous medium S breaks at a position where an actuator 42 is provided, as illustrated in FIG. 6A. When the continuous medium S breaks at the position of the actuator 42, the actuator 42 does not nip the continuous medium S. As a result, light emitted from a light emitting portion is received by a light receiving portion in the actuator 42, and breakage of the continuous medium S is detected.

On the other hand, an encoder 45 detects the presence of the continuous medium S.

Thus, a controller 60 determines that a position X where the continuous medium S has broken is at the position of the actuator 42 or between the position of the actuator 42 and the position of the encoder 45.

When the actuator 42 detects breakage of the continuous medium S, transportation of the continuous medium S is stopped. Also, power feeding to a heater 313 of a fixing roller 31 is stopped.

When the actuator 42 detects breakage of the continuous medium S, as illustrated in FIG. 6B, a pressurizing roller 32 is moved in the direction of arrow D in FIG. 6B by an advancing/retreating mechanism 33 to release pressurization at a nip N.

Next, in this exemplary embodiment, a paper feeding roller 71, the entrance roller 21, the second transfer roller 14, and the backup roller 15 are driven to transport an upstream part S1 toward the working area R in a direction of arrow F in FIG. 6B (toward the upstream side in the transport direction). Then, the upstream part S1 is taken up by the paper feeding roller 71.

Also, an exit roller 22 and a collection roller 81 are driven to transport a downstream part S2 toward the working area R in the direction of arrow F in FIG. 6B (toward the upstream side in the transport direction).

When a downstream edge portion S1*a* of the upstream part S1 reaches the inside of the working area R, as illustrated in FIG. 6C, transportation of the upstream part S1 is stopped.

Also, when an upstream edge portion S2*a* of the downstream part S2 reaches the inside of the working area R, transportation of the downstream part S2 is stopped.

In this way, in this exemplary embodiment, when breakage of the continuous medium S is detected, the upstream part S1 and the downstream part S2 are transported until the downstream edge portion S1*a* and the upstream edge portion S2*a* move into the working area R.

In the exemplary embodiments described above, the detection device 40 includes the optical sensor 41, the actuator 42, the pressurizing-roller torque sensor 43, the exit-roller torque sensor 44, and the encoder 45.

It is only required that the detection device 40 should include at least one structure for detecting breakage of the continuous medium S during transportation. In this case, to restrict the broken continuous medium S from being wound around the fixing device 30, the optical sensor 41 or the actuator 42 may be provided immediately after the fixing device 30, or the presence or absence of the continuous medium S at the position of the fixing device 30 may be detected.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section configured to form an image on a continuous medium and comprising a fixing section configured to fix the image on the continuous medium;

a transport unit configured to transport the continuous medium; and a detection unit configured to detect breakage of the continuous medium transported by the transport unit from a transport state of the continuous medium; wherein:

when the detection unit is configured to detect the breakage of the continuous medium on an upstream side of the fixing section in a transport direction, the transport unit is configured to transport a part located on an upstream end of a downstream side in the transport direction, of two parts of the continuous medium divided by the breakage, to the downstream side of the fixing section in the transport direction, and when the detection unit detects the breakage of the continuous medium on the downstream side of the fixing section in a transport direction, the transport unit is not configured to transport the part located on the upstream end of the downstream side in the transport direction, of two parts of the, continuous medium divided by the breakage.

2. The image forming apparatus according to claim 1, wherein the image forming section is configured to the image on the continuous medium by heating and pressurizing the continuous medium when the continuous medium on which the image is formed passes through a nip, and wherein the image forming apparatus further comprises a unit that releases pressurization at the nip when the detection unit detects the breakage of the continuous medium.

3. The image forming apparatus according to claim 1, wherein the image forming section includes a fixing unit that fixes the image on the continuous medium by heating and pressurizing the continuous medium on which the image is formed, and wherein, when the detection unit detects that the breakage of the continuous medium occurs at a position where the fixing unit is located or on an upstream side of the fixing unit in a transport direction, the transport unit is configured to transport an upstream part located on the upstream side in the transport direction, of two parts of the continuous medium divided by the breakage, to the upstream side or stops transportation of the upstream part.

4. The image forming apparatus according to claim 1, when the detection unit detects the breakage of the continuous medium on the upstream side of the fixing section in a transport direction, the transport unit is not configured to transport the part located on the downstream end of the upstream side in the transport direction, of two parts of the continuous medium divided by the breakage.

5. An image forming apparatus comprising:

an image forming section configured to form an image on a continuous medium and comprising a fixing section configured to fix the image on the continuous medium;

a transport unit configured to transport the continuous medium; and a detection unit configured to detect breakage of the continuous medium transported by the transport unit from a transport state of the continuous medium, wherein:

when the detection unit detects the breakage of the continuous medium on an upstream side of the fixing section in a transport direction, the transport unit is configured to transport the part located on a downstream end of the upstream side in the transport direction, of two parts of the continuous medium divided by the breakage, to the upstream side in the transport direction, and when the detection unit detects the breakage of the continuous medium on a downstream side of the fixing section in the transport direction, the transport unit is configured to transport the part located on the downstream end of the upstream side in the transport direction, of two parts of the continuous medium divided by the breakage, to the downstream side in the transport direction.

6. A continuous-medium transport device comprising:

an image forming device including:

an image forming section configured to form an image on a continuous medium; and a fixing section configured to fix the image on the continuous medium;

a transport unit that configured to transport a continuous medium; and a detection unit configured to detect breakage of the continuous medium transported by the transport unit from a transport state of the continuous medium;

wherein, when the detection unit detects the breakage of the continuous medium, the transport unit is configured to transport a first part located on a downstream end of an upstream side in a transport direction, of two parts of the continuous medium divided by the breakage, and a second part located on the upstream end of the downstream side in the transport direction, of two parts of the continuous medium divided by the breakage, to the downstream side in the transport direction so that both of the first part and the second part are configured to be discharged out of the image forming device.

* * * * *